United States Patent [19]

Oquita

[11] 4,092,798

[45] June 6, 1978

[54] BALLOON PINATA

[76] Inventor: Ramiro Oquita, 6014 Chandler Dr., San Diego, Calif. 92117

[21] Appl. No.: 758,215

[22] Filed: Jan. 10, 1977

Related U.S. Application Data

[63] Continuation-in-part of Ser. No. 617,602, Sep. 29, 1975.

[51] Int. Cl.[2] ..... A63H 35/00

[52] U.S. Cl. ..... 46/11; 46/88

[58] Field of Search ..... 46/11, 38, 88; 229/7 R

[56] References Cited

U.S. PATENT DOCUMENTS

| | | | |
|---|---|---|---|
| 1,732,282 | 10/1929 | Sage | 229/7 R X |
| 3,702,675 | 11/1972 | Bajo | 46/11 X |

*Primary Examiner*—F. Barry Shay

*Attorney, Agent, or Firm*—Nilsson, Robbins, Dalgarn, Berliner, Carson & Wurst

[57] ABSTRACT

A pinata comprising a housing enclosing a plurality of small items carried on a bottom wall. The bottom wall is formed with a central aperture through which the neck of a balloon is secured by means of a suspension string passing through the housing. Upon breaking of the balloon, the bottom wall falls away, releasing the items.

6 Claims, 5 Drawing Figures

FIG. 1
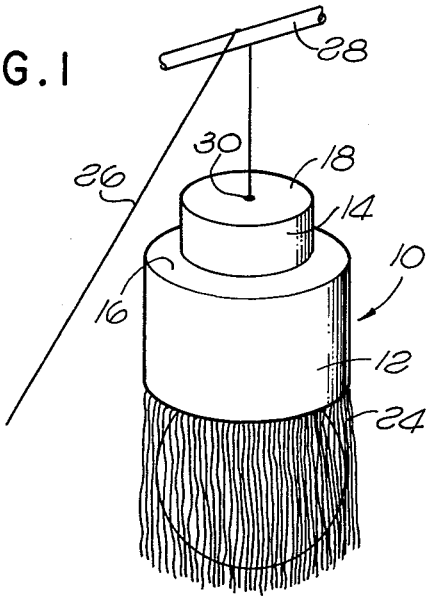
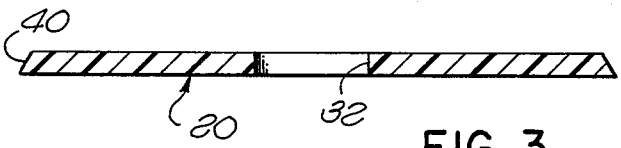
FIG. 3
FIG. 2
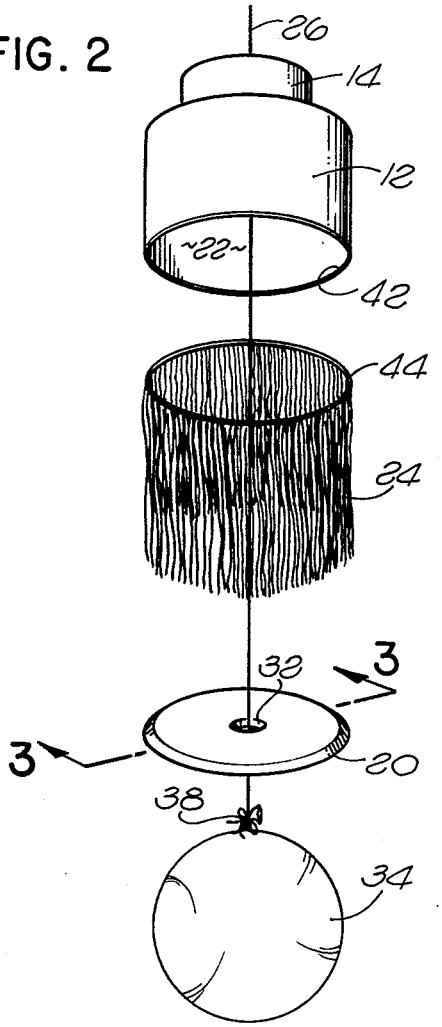
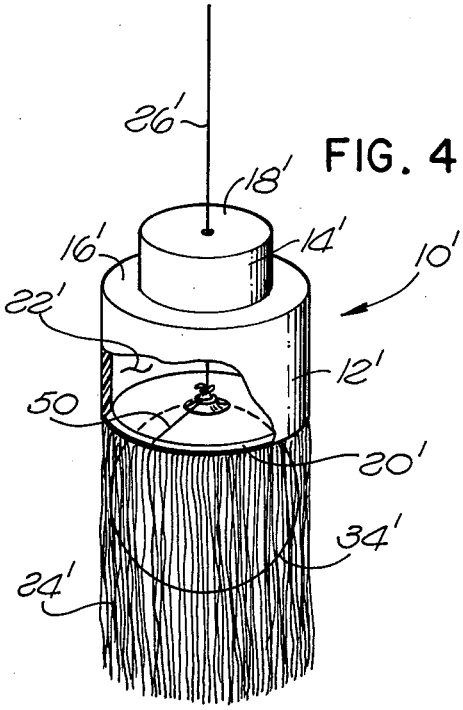
FIG. 4
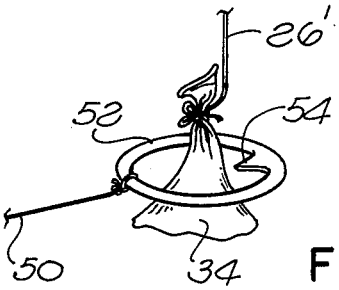
FIG. 5

BALLOON PINATA

RELATED APPLICATION

This application is a continuation-in-part of my application Ser. No. 617,602, filed Sept. 29, 1975.

FIELD OF THE INVENTION

The field of art to which the invention pertains includes the field of containers, specifically pinatas.

BACKGROUND AND SUMMARY OF THE INVENTION

Pinata breaking celebrations are quite popular in Mexico and in the Mexican communities of the southwestern United States. Pinatas are traditionally formed as a pot or container ornamented with colorful paper and filled with candy, nuts, confetti and/or token gifts such as small toys and the like. The pinata is suspended above a party area and at the appropriate time, and with celebration, it is broken so that the treats are scattered among the guests who in turn can keep whatever they collect. The usual method of breaking the pinata is by beating it with a club or cane and this is either done by a blindfolded child who is the subject of the celebration or by several children in succession, each given a certain number of turns in which to break the pinata. The traditional pinata is made of clay pottery and large falling fragments can cause injury to a young child. Modern pinatas are often made of papier mache, avoiding the dangers of cracked clay fragments, but such pinatas are generally quite difficult for young children to break.

The present invention provides a pinata which avoids the foregoing drawbacks. The pinata includes a bottom wall having an extended surface and side and top walls which cooperate with the bottom wall to define a substantially enclosed chamber whereby a plurality of small items such as candy, toys and the like may be carried in the chamber on the bottom wall. The bottom wall is formed with a central aperture sufficiently large for passage therethrough of a deflated balloon. The neck of such a balloon is secured by means of a string which passes through a top portion of the housing. When the balloon is inflated, the string serves as a suspension line whereby the pinata may be suspended from any convenient point. The suspension line and balloon hold the bottom wall in assembled relation with but free of direct attachment to, the side and top wall of the pinata. Accordingly, when the balloon is broken, the broken, deflated portions of the balloon can pass through the aperture in the bottom wall so that the bottom wall can fall away from the pinata.

In one embodiment, a pull line is connected via a rupture collar to the neck of the ballon internally of the pinata, and trails through one edge of the bottom wall to be suspended therefrom. In this embodiment, the rupture collar is a ring around the neck of the balloon formed with an internal pointed portion thereon so that when the pull line is tugged, the point pierces the neck of the balloon, rupturing the balloon. In this embodiment, a plurality of decoy lines of like construction can be provided extending a like distance from the bottom wall whereby to disguise the identity of the pull line. The guests can try to guess which of the many lines are decoy lines and which is the true pull line. In another embodiment, a pole with a small tack at the end can be used in an attempt to pierce the balloon. In either case, an enjoyable and stimulating pinata is provided. It will be appreciated that the only component which is broken from the pinata is the balloon. Therefore, one can utilize the pinata on many occasions with replacement required only of the balloon.

BRIEF DESCRIPTION OF THE DRAWINGS

FIG. 1 is a perspective view showing one form of pinata in accordance with one embodiment of the present invention whereby a stick is used to burst the pinata balloon.

FIG. 2 is a perspective, exploded view of the pinata of FIG. 1;

FIG. 3 is a cross sectional view of the bottom wall of FIG. 1 taken on line 3—3 of FIG. 2;

FIG. 4 is a perspective, partially cut-away view of a pinata which is similar in its external appearance to the pinata of FIG. 1 but which operates in accordance with a pull line connected to the neck of the balloon; and FIG. 5 is a perspective view of a rupture collar for use in the embodiment of FIG. 4.

DETAILED DESCRIPTION

As required, detailed illustrative embodiments of the invention are disclosed herein. However, it is to be understood that these embodiments merely exemplify the invention which may take forms that are different from the specific illustrative embodiments disclosed. Therefore, specific structural and functional details are not to be interpreted as necessarily limiting, but as a basis for the claims which define the scope of the invention.

Referring to FIGS. 1 and 2, a pinata 10 is disclosed having a layer of stacked, generally cylindrical side walls 12 and 14 and concentric top walls 16 and 18 arranged in two-tier form to simulate a birthday cake. The side walls can be in parallel cylindrical form or can have a draft of 3°–5° for stacking during manufacture. A bottom wall 20 closes with the lowermost cylindrical side wall 12 so that a chamber 22 is obtained by cooperation of the bottom wall 20 and side and top walls 12, 14, 16 and 18. A plurality of decorative paper streamers 24 depend from the perimeter of the bottom wall 20. The pinata 10 is suspended by means of a line 26 looped over a supporting beam 28. The suspension line 26 extends through a close fitting central opening 30 formed in the top wall 18 therefor and from there through a central aperture 32 formed through the bottom wall 20. The end of the suspension line 26 is tied around the neck of a balloon 34 by means of simple knot 38.

Referring additionally to FIG. 3, the bottom wall 20 is in the form of a generally planar disc with an upwardly tapered perimeter 40 which abuts against the like-tapered perimeter 42 of the pinata side wall 12. A ring 44 of wire or the like is carried on the tapered portion 40 of the bottom wall 20 and is wedged snugly between bottom wall 20 and tapered perimeter 42 of the cylindrical side wall 12. The ring 44 carries the above-referred-to of decorative paper streamers 24. In place of paper streamers, one could, of course use cloth streamers or one could use strings which can be variously colored as desired.

To set up the pinata, it is inverted and a string is passed through the opening 30 in the top wall 18. The pinata is then filled with toys, candy or other small items. The string is threaded through the ring 44 of streamers, and then through the aperture 32 in the bottom wall 20, whereupon it is tied to the neck of an inflated balloon 34. The string 26 is pulled so that the bottom wall 20 wedges the streamer ring 44 against the tapered perimeter 42 of the pinata side wall 12, enclosing the small items. The pinata is then suspended by means of the string 26 over a supporting beam such as at 28 in FIG. 1. In play, the guest of honor is blindfolded and given a stick with a very small tack, pin or the like at the end, which he jabs upwardly to attempt to break the balloon. When the balloon 34 breaks, the weight of the treats inside the pinata bearing on the bottom wall 20 causes the bottom wall 20 to fall away to release the treats. Subsequently, the pinata can be reused by simply replacing the balloon 34.

Referring now to FIG. 4, an alternative embodiment is illustrated in which the pinata 10' is similar in all respects to the pinata 10 of FIG. 1 including side walls 12' and 14' and top walls 16' and 18' cooperating with a bottom wall 20' to form a chamber 22' in which treats can be stored. A suspension line 26' extends through the top wall 18' and is centrally connected through the bottom wall 20' to the neck of a balloon 34' thereat.

Referring additionally to FIG. 5, in the alternative embodiment there is provided a pull line 50 connected to a rupture collar 52 and which trails therefrom to the edge of the bottom wall 20, and then dependent therefrom. The rupture collar 52 is in the form of a ring encircling the neck of the balloon 34 and is formed with an internally directed pointed region 54. Upon pulling of the pull line 50, the rupture collar point 52 pierces the neck of the balloon causing the balloon to rupture, whereupon the bottom wall 20' falls away to spill the treats contained in the chamber 22'.

It will be appreciated that the use of a balloon rupturable in accordance with the present invention adds a dimension of enjoyment not otherwise present in the usual pinata breaking ceremony. In this regard, the rupture of the balloon is sudden and swift with a loud bang. As a further feature, the pull line 50 extends downwardly from the bottom wall 20' a distance which is the same as that of the streamers 24' and the streamers 24' are of like construction to the pull line 50 so as to serve as decoys therefor. In this regard, the pull line 50 and streamers 24' can be formed of cord or can be each cloth streamer, or even paper streamer if the paper is sufficiently strong to withstand the thrust necessary to rupture the balloon 34'.

In use of the second embodiment, the various guests at the party can take turns in guessing which of the streamers 24' leads to bursting of the balloon. Each guest would then pull on his chosen streamer until it breaks or until, if it is the pull line 50, the balloon bursts and the bottom wall falls away, spilling the treats.

The pinata in each of the foregoing embodiments is constructed of rigid, foamed polystyrene, but each unit could be made of other materials as previously indicated. Additionally, various changes can be made in the present invention without departing from the spirit of the invention as defined by the appended claims.

I claim:

1. A pinata, comprising:

a bottom wall having an extended surface;

side and top walls cooperating with said bottom wall to define a substantially enclosed chamber whereby a plurality of small items may be carried in said chamber on said bottom wall; said chamber including separable parts; and means for holding said separable parts in assembled relation including a balloon and means for suspending said pinata, said latter means being connected to said balloon whereby bursting of said balloon while the pinata is suspended causes said parts to separate thereby opening said chamber for release of the contents of said chamber.

2. The pinata of claim 1 wherein said means connected to said balloon comprises a suspension line through a close fitting opening therefor in the top wall of said pinata and through an aperture in said bottom wall large enough to pass said balloon after bursting thereof.

3. The pinata of claim 1 including a pull line dependent from said bottom wall and rupture means connected to said pull line operative to burst said balloon upon pulling on said pull line.

4. The pinata of claim 3 including a plurality of decoy lines of like construction to said pull line and extending a like distance from said bottom wall whereby to disguise the identity of said pull line.

5. The pinata of claim 3 wherein said rupture means comprises a collar, interiorly of said pinata, having an inside surface formed to rupture a balloon, the neck of said balloon extending through said collar.

6. The pinata of claim 1 formed of rigid, foamed polystyrene.

* * * * *